US006871511B2

(12) United States Patent
Okaza et al.

(10) Patent No.: US 6,871,511 B2
(45) Date of Patent: Mar. 29, 2005

(54) REFRIGERATION-CYCLE EQUIPMENT

(75) Inventors: Noriho Okaza, Shiga (JP); Masami Funakura, Osaka (JP); Fumitoshi Nishiwaki, Hyogo (JP); Yuji Yoshida, Hyogo (JP); Yuuichi Yakumaru, Osaka (JP)

(73) Assignee: Matsushita Electric Industrial Co., Ltd.

( * ) Notice: Subject to any disclaimer, the term of this patent is extended or adjusted under 35 U.S.C. 154(b) by 0 days.

(21) Appl. No.: 10/467,576

(22) PCT Filed: Feb. 20, 2002

(86) PCT No.: PCT/JP02/01441

§ 371 (c)(1),
(2), (4) Date: Dec. 18, 2003

(87) PCT Pub. No.: WO02/066907

PCT Pub. Date: Aug. 29, 2002

(65) Prior Publication Data

US 2004/0089018 A1 May 13, 2004

(30) Foreign Application Priority Data

Feb. 21, 2001 (JP) ..... 2001-044725
Jan. 17, 2002 (JP) ..... 2002-008390
Jan. 17, 2002 (JP) ..... 2002-008400

(51) Int. Cl.[7] ..... F25B 1/00
(52) U.S. Cl. ..... 62/498
(58) Field of Search ..... 62/115, 174, 498

(56) References Cited

U.S. PATENT DOCUMENTS 5,655,378 A 8/1997 Pettersen
6,085,544 A 7/2000 Sonnekalb et al.
6,250,099 B1 6/2001 Furuya et al.
6,591,618 B1 * 7/2003 Howard et al. ..... 62/114

FOREIGN PATENT DOCUMENTS

| | | |
|---|---|---|
| JP | 07-018602 | 1/1995 |
| JP | 2804844 B2 | 7/1998 |
| JP | 11-173688 A | 7/1999 |
| JP | 11-351680 A | 12/1999 |
| JP | 2000-46420 A | 2/2000 |
| JP | 2000-46421 A | 2/2000 |
| JP | 2000-110725 A | 4/2000 |
| JP | 2000-161213 A | 6/2000 |
| JP | 2000-274890 A | 10/2000 |
| JP | 2000-515958 A | 11/2000 |

OTHER PUBLICATIONS

Japanese International Search Report for PCT/JP02/01441, dated May 21, 2002.

J. Pettersen et al. "Development of compact heat exchangers for $CO_2$ air–conditioning systems", International Journal of Refrigeration, 1998, vol. 21, No. 3, pp. 180–193.

Microfilm of the specification and drawings annexed to the request of Japanese Utility Model Application No. 133412/1988 (Laid–open No. 55063/1990), Caisonic Corp., Apr. 20, 1990.

* cited by examiner

*Primary Examiner*—Melvin Jones
(74) *Attorney, Agent, or Firm*—RatnerPrestia

(57) ABSTRACT

Refrigeration-cycle equipment wherein an oil separator is installed as a refrigerant vessel in a part of the high-pressure-side circuit. A linear compressor of an oil-less type or an oil-poor type is used. Alternatively, the quantity of the $CO_2$ refrigerant filled in the circuit is 0.25 kg or less per liter on the basis of the total internal volume of the circuit.

25 Claims, 7 Drawing Sheets

REFRIGERATION-CYCLE EQUIPMENT

This application is a U.S. National Phase Application of PCT International Application PCT/JP02/01441. Filed Feb. 20, 2002.

TECHNICAL FIELD

The present invention relates to refrigeration-cycle equipment using a carbon dioxide (hereafter referred to as $CO_2$) refrigerant as the refrigerant.

BACKGROUND ART

Refrigeration-cycle equipment having a compressor, a radiator, a pressure reducer, an evaporator have been used in the past in an air conditioner, a car air conditioner, an electric refrigerator (freezer), cold or refrigerated warehouse, a showcase and the like. Such refrigeration-cycle equipment have used as the refrigerant hydrocarbons containing fluorine atoms.

In particular, since hydrocarbons containing both fluorine atoms and chlorine atoms (HCFC, hydrochlorofluorocarbons) have high performance, and are incombustible and nontoxic to humans, they have been widely used in refrigeration-cycle equipment.

However, it has been known that since HCFCs (hydrochlorofluorocarbons) contain chlorine atoms, when they are released in the air and reach the stratosphere, they destroy ozone layers HFCs (hydrofluorocarbons), which do not contain chlorine atoms are being used in place of HCFCs, and do not destroy ozone layers. HFC's, however, have a large greenhouse effect because they have a long life in the air, and cannot be said to be a satisfactory refrigerant for preventing undesirable global warming.

The feasibility of refrigeration-cycle equipment using $CO_2$ is being studied. The ozone depletion potential (ODP) of $CO_2$ is zero, and its global warming factor is markedly small compared to halogen-atom-containing hydrocarbons, such as HCFCs and HFCs, which contain halogen atoms. For example, refrigeration-cycle equipment using $CO_2$ is proposed in Japanese Patent Publication No. 7-18602.

This Japanese Patent Publication discloses that the critical temperature of $CO_2$ is 31.1° C. and the critical pressure is 7,372 kPa, and the refrigeration-cycle equipment using $CO_2$, can operate in a transcritical cycle described using FIG. 4.

FIG. 4 is a Mollier diagram of a refrigeration cycle using $CO_2$ as a refrigerant.

As A-B-C-D-A in the drawing shows, by the compression stroke (A-B) for compressing $CO_2$ refrigerant in a gas-phase state with a compressor, the cooling stroke (B-C) for cooling the high-temperature high-pressure $CO_2$ refrigerant in a super critical state with a radiator (gas cooler), the pressure-reducing stroke (C-D) for reducing the pressure with a pressure reducer, and the evaporation stroke (D-A) of the evaporator for evaporating the $CO_2$ refrigerant in a gas-liquid two-phase state, heat is absorbed from an external fluid, such as the air, with the latent heat of evaporation, and the external fluid is cooled.

In FIG. 4, transition from the saturated vapor region (gas-liquid two-phase region) to the heated vapor region (gas-phase region) in the evaporation stroke (D-A) is performed in the same manner as in the case of HCFCs or HFCs, and the line (B-C) is located in the high-pressure side above the critical point CC and never intersects the saturated-liquid line and the saturated-vapor line.

Specifically, in the region exceeding the critical point CC (supercritical region), no condensation stroke as in the case of HCFCs or HFCs is present, but the cooling stroke wherein the $CO_2$ refrigerant is cooled without being reliquefied.

At this time, since the working pressure of the refrigeration-cycle equipment using a $CO_2$ refrigerant is about 3.5 MPa for the low-pressure-side pressure, and about 10 MPa for the high-pressure-side pressure, the working pressure is higher than in the case of using HCFCs or HFCs, and the high-pressure-side pressure and the low-pressure-side pressure are about 5 to 10 times the working pressure of the refrigeration-cycle equipment using HCFCs or HFCs.

The working pressure of the refrigeration-cycle equipment operating in the transient critical high pressure depends on several factors, such as the quantity of the filled refrigerant, the factor volume and the cooling stroke temperature, and if the working pressure deviates from the optimal high-pressure-side pressure during operation, relatively low freezing capacity and a low efficiency may result. Therefore, it is necessary to make the high-pressure-side pressure in operation agree to the optimal high-pressure-side pressure by controlling the quantity of the filled refrigerant during the operation of the refrigeration-cycle equipment at rest, to achieve a relatively high freezing capacity and a high efficiency.

To achieve this, Japanese Patent No. 2804844 proposes that the volume of the high-pressure-side circuit should be large relative to the volume of the low-pressure-side circuit, and more specifically, it proposes that the volume of the high-pressure-side circuit should be 70% or more of the total internal volume, and that the refrigerant quantity of the filled $CO_2$ refrigerant should be 0.55 to 0.70 kg per liter on the basis of the total internal volume. The entire disclosure of the reference of Japanese Patent No. 2804844 is incorporated herein by reference in its entirety.

However, in order that the refrigerant flow path of the heat exchanger used in the radiator or the evaporator of such refrigeration-cycle equipment resists the pressure of the high-pressure refrigerant, a flat tube 51 having a plurality of through-holes 51*a* of a small bore diameter is shown in the schematic diagram of FIG. 5.

In order to minimize the pressure loss of the refrigerant in the heat exchanger or connecting pipes, it is desirable to enlarge the sectional area of the low-pressure-side refrigerant circuit, rather than the sectional area of the high-pressure-side refrigerant circuit.

Furthermore, in order to resist the pressure of the high-pressure refrigerant, it is desirable that the shell of the compressor is of a low-pressure shell type. As a result, the volume of the low-pressure-side circuit including the shell space of the compressor becomes relatively larger than the volume of the high-pressure-side circuit.

Specifically, the volume of the high-pressure-side circuit normally becomes less than 70% the total internal volume. Here, the high-pressure-side circuit means the component elements and connecting pipes (specifically, the discharging portion of the compressor, the radiator, the pressure reducer and the like) wherein the $CO_2$ refrigerant of relatively high pressure operates during the operation of the refrigeration-cycle equipment, among the closed circuit constituting the refrigeration-cycle equipment. The low-pressure-side circuit means the component elements and connecting pipes wherein the $CO_2$ refrigerant of relatively low pressure operates (specifically, the pressure reducer, the evaporator, the compressor and the like).

In refrigeration-cycle equipment wherein the volume of the high-pressure-side circuit is less than 70% the total internal volume, when the quantity of the filled $CO_2$ refrigerant is large, or the quantity of the oil discharged together with the $CO_2$ refrigerant is large, there is the possibility of the rapid pressure rise in the high-pressure-side circuit.

The rapid pressure rise occurs due to the fact that the density of the $CO_2$ refrigerant in the high-pressure-side circuit increases when the quantity of the refrigerant retained in the low-pressure-side circuit is transferred to the high-pressure-side circuit of a relatively small volume; or that the oil discharged together with the $CO_2$ refrigerant further decreases the volume of the high-pressure-side circuit of a relatively small volume. This occurs easily especially in the startup of the refrigeration-cycle equipment. When the rapid pressure rise occurs in the high-pressure-side circuit, problems may arise, such that the high-pressure protecting mechanism operates to stop the compressor in order to protect the radiator, the evaporator and the compressor of the refrigeration-cycle equipment from the high pressure, and thereby startup becomes difficult.

DISCLOSURE OF THE INVENTION

The object of the present invention is to provide refrigeration-cycle equipment that can reduce the sharp pressure rise in the refrigerant circuit compared with conventional equipment considering the above-described problems in such conventional refrigeration-cycle equipment.

A first aspect of the present invention is refrigeration-cycle equipment whose refrigerant circuit is composed at least of a compressor, a pressure reducer, a radiator and an evaporator, and encloses a refrigerant consisting mainly of carbon dioxide ($CO_2$), wherein the internal volume of the high-pressure-side circuit of said refrigerant circuit is less than 70% of the total internal volume of said refrigerant circuit, and a predetermined vessel member is provided in the way of said high-pressure-side circuit.

A second aspect of the present invention is the refrigeration-cycle equipment according to the first aspect of the present invention, wherein said vessel member is a vessel having a piping cross-sectional area larger than the piping cross-sectional area of said refrigerant circuit, and includes internally a refrigerant reservoir chamber and/or oil separating means.

A third aspect of the present invention is the refrigeration-cycle equipment according to the second aspect of the present invention, wherein said vessel member is a cylindrical vessel; and said vessel member comprises (1) an inlet pipe installed in the vicinity of the upper end of said cylindrical vessel, and in the tangential direction to the inside peripheral surface of said cylindrical vessel; (2) a refrigerant outlet pipe installed through the center portion of the upper end of said cylindrical vessel, and inside said cylindrical vessel downwardly; (3) an oil outlet pipe installed on the lower end of said vessel; and (4) a revolving plate imparting revolution to the refrigerant and the oil installed in said vessel.

A fourth aspect of the present invention is the refrigeration-cycle equipment according to any of the first to the third aspects of the present invention, further comprising refrigerant cooling means for cooling said refrigerant by using a part of a high-pressure-side circuit and a part of a low-pressure-side circuit, wherein said vessel member is installed between said refrigerant cooling means and said pressure reducer.

A fifth aspect of the present invention is the refrigeration-cycle equipment according to the first aspect of the present invention, further comprising refrigerant cooling means for cooling said refrigerant by using a part of a high-pressure-side circuit and a part of a low-pressure-side circuit, wherein a part of said high-pressure-side circuit is also used as said vessel member.

A sixth aspect of the present invention is the refrigeration-cycle equipment according to the fourth aspect of the present invention, wherein said refrigerant cooling means is an auxiliary heat exchanger for exchanging heat between a radiation-side refrigerant flow path formed between the outlet side of said radiator and the inlet side of said pressure reducer, and an evaporation-side refrigerant flow path formed between the outlet side of said evaporator and the suction side of said compressor.

A seventh aspect of the present invention is the refrigeration-cycle equipment according to any of the first to the sixth aspects of the present invention, wherein a ratio of weight of an oil to weight of carbon dioxide ($CO_2$) refrigerant circulating said high-pressure-side circuit is substantially 2% or below when said refrigeration-cycle equipment is in operation.

An eighth aspect of the present invention is the refrigeration-cycle equipment according to any of the first to the seventh aspects of the present invention, wherein the carbon dioxide ($CO_2$) refrigerant of a quantity of substantially 0.25 kg or less per liter is filled in said refrigerant circuit.

A ninth aspect of the present invention is the refrigeration-cycle equipment according to any of the first to the eighth aspects of the present invention, wherein an oil is filled in the volume less than 50% an internal volume of a shell excluding volume of a compression mechanism portion out of volume of said compressor.

A tenth aspect of the present invention is the refrigeration-cycle equipment according to any of the first to the ninth aspects of the present invention, wherein said compressor is a linear compressor of an oil-less type or an oil-poor type.

An eleventh aspect of the present invention is the refrigeration-cycle equipment according to any of the first to the tenth aspects of the present invention, wherein said radiator has a constitution wherein a plurality of through-holes having a hydraulic-power corresponding diameter of 0.2 mm to 6.0 mm formed in a flat tube are used as the refrigerant paths.

A twelfth aspect of the present invention is the refrigeration-cycle equipment according to any of the first to the eleventh aspects of the present invention, wherein an oil filled in said compressor is an oil insoluble in carbon dioxide ($CO_2$) refrigerant.

A thirteenth aspect of the present invention is refrigeration-cycle equipment whose refrigerant circuit comprises at least a compressor, a pressure reducer, a radiator and an evaporator, and an internal volume of a high-pressure-side circuit is less than 70% a total internal volume of said refrigerant circuit, wherein carbon dioxide ($CO_2$) refrigerant of a quantity of 0.25 kg or less per liter is filled in said refrigerant circuit.

A fourteenth aspect of the present invention is the refrigeration-cycle equipment according to the thirteenth aspects of the present invention, wherein a ratio of weight of an oil to weight of the carbon dioxide ($CO_2$) refrigerant circulating said high-pressure-side circuit is 2% or below when said refrigeration-cycle equipment is in operation.

A fifteenth aspect of the present invention is the refrigeration-cycle equipment according to the thirteenth or the fourteenth aspects of the present invention, wherein an oil is filled in the volume less than substantially 50% an internal volume of a shell excluding volume of a compression mechanism portion out of the volume of said compressor.

A sixteenth aspect of the present invention is the refrigeration-cycle equipment according to any of the thirteenth to the fifteenth aspects of the present invention, wherein said compressor is a linear compressor of an oil-less type or an oil-poor type.

A seventeenth aspect of the present invention is the refrigeration-cycle equipment according to any of the thirteenth to the sixteenth aspects of the present invention, wherein said radiator comprises a plurality of through-holes having a hydraulic-power corresponding diameter of substantially 0.2 mm to 6.0 mm formed in a flat tube are used as the refrigerant paths.

An eighteenth aspect of the present invention is the refrigeration-cycle equipment according to any of the thirteenth to the seventeenth aspects of the present invention, wherein an oil filled in said compressor is an oil insoluble in the carbon dioxide ($CO_2$) refrigerant.

According to the above-described aspects of the invention, there is provided refrigeration-cycle equipment using a flat tube having a plurality of through-holes of a small bore diameter as refrigerant paths of the radiator and the evaporator, using a $CO_2$ refrigerant, and having means to reduce sharp pressure rise; and the optimal relationship between the quantities of the $CO_2$ refrigerant and the oil filled in the refrigeration-cycle equipment that prevents sharp pressure rise.

(DESCRIPTION OF SYMBOLS)

Figure 1:
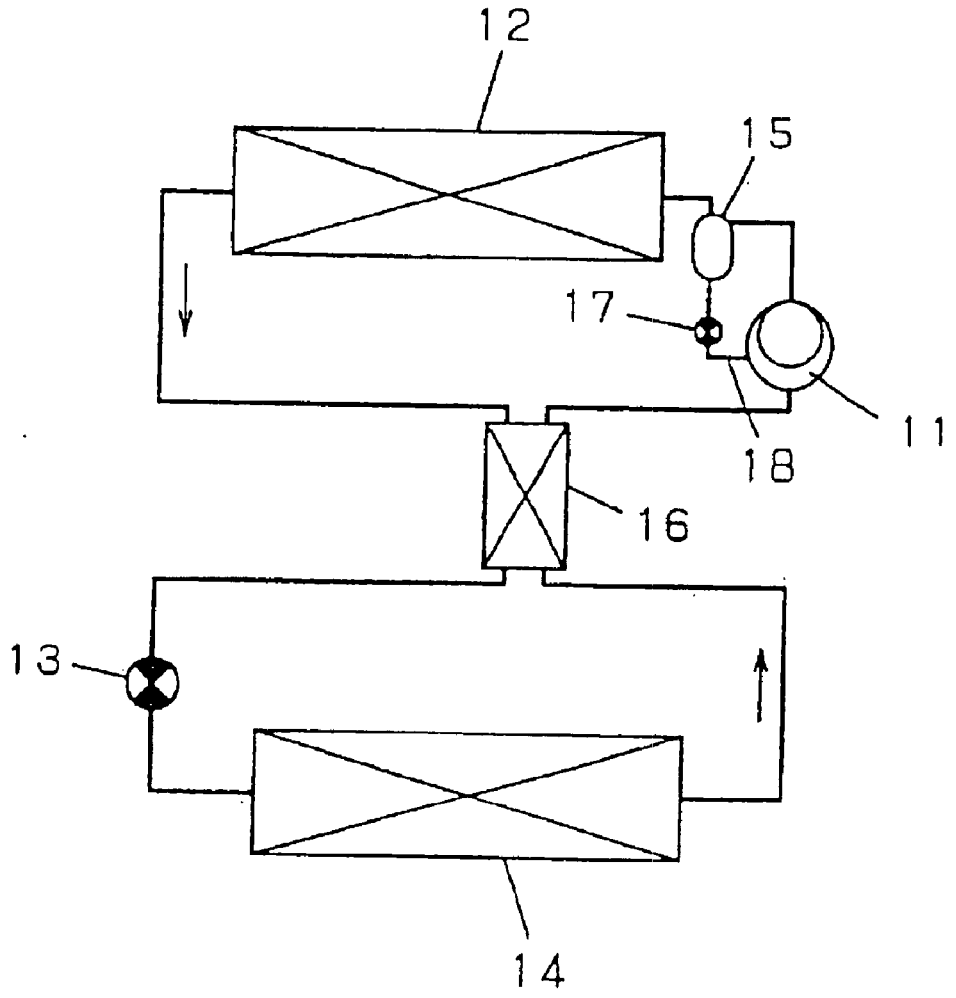
FIG. 1 is a schematic constitution diagram of refrigeration-cycle equipment according to Embodiment 1 of the present invention.

11 Compressor
12 Radiator
13 Pressure reducer
14 Evaporator
15 Oil separator
16 Auxiliary heat exchanger
17 Subsidiary pressure reducer
22 Refrigerant inlet pipe
23 Refrigerant outlet pipe
25 Revolving plate
26 Oil outlet pipe
27 Demister
31 Refrigerant storage vessel
51 Flat tube
51*a* Through-hole Best Mode for Carrying out the Invention The embodiments of the present invention will be described below.

(Embodiment 1)

The constitution of refrigeration-cycle equipment according to Embodiment 1 of the present invention is schematically shown in FIG. 1.

In the drawing, the reference numeral 11 denotes a linear compressor of a low-pressure shell type, 12 denotes a radiator having a plurality of through-holes formed in a flat tube as refrigerant paths, 13 denotes a pressure reducer, and 14 denotes an evaporator having a plurality of through-holes formed in a flat tube as refrigerant paths; and a closed circuit is formed by connecting these with pipes to constitute a refrigeration cycle wherein a refrigerant circulates in the direction of the arrows in the drawing, and $CO_2$ that can be in a super critical state in a path to be the radiation side (flow path from the discharging portion of the compressor 11 through the radiator 12 to the inlet portion of the pressure reducer 13) is filled as a refrigerant.

Furthermore, there is provided an auxiliary heat exchanger 16 for exchanging heat between a radiation-side refrigerant path, which is a refrigerant path from the outlet of the radiator 12 to the inlet of the pressure reducer 13, and a evaporation-side refrigerant path, which is a refrigerant path from the outlet of the evaporator 14 to the inlet of the compressor 11.

Also, the refrigeration cycle is constituted so that an oil separator 15 is installed between the compressor 11 and the radiator 12, and the oil separated in the oil separator 15 is fed back from the oil outlet pipe of the oil separator 15 through the subsidiary pressure reducer 17 and through an auxiliary path 18 connected to the compressor 11 with a pipe, to the compressor 11.

The hydraulic-power corresponding diameter of a plurality of through-holes formed in the flat tube was determined to be about 0.6 mm for resisting the pressure of the high-pressure refrigerant. The internal volume of the high-pressure-side circuit of the refrigeration-cycle equipment thus constituted was less than 70% the total internal volume.

The vessel member of the present invention corresponds to the oil separator 15. The refrigerant cooling means of the present invention corresponds to the auxiliary heat exchanger 16.

The operation of the refrigeration-cycle equipment having the above-described constitution will be described.

The $CO_2$ refrigerant compressed by the compressor 11 (in this embodiment, the $CO_2$ refrigerant is compressed to, for example, about 10 MPa) is in a high-temperature, high-pressure state, and is introduced into the radiator 12. In the radiator 12, since the $CO_2$ refrigerant is in a super critical state, the $CO_2$ refrigerant dissipates heat to a medium such as the air and water without becoming the gas-liquid two-phase state. Thereafter, the $CO_2$ refrigerant is further cooled in the radiation-side refrigerant path from the outlet of the radiator 12 to the inlet of the pressure reducer 13 in the auxiliary heat exchanger 16.

In the pressure reducer 13, the pressure is reduced (in this embodiment, the pressure is reduced to, for example, about 3.5 MPa), and the $CO_2$ refrigerant becomes in a low-pressure gas-liquid two-phase state, and is introduced into the evaporator 14. Furthermore, the $CO_2$ refrigerant absorbs heat in the evaporator 14 from the air or the like; becomes in a gas state in the evaporation-side refrigerant path from the outlet of the evaporator 14 to the suction portion of the compressor 11 in the auxiliary heat exchanger 16, and is sucked into the compressor 11 again.

By repeating such a cycle, the heating action by heat radiation is performed in the radiator 12, and the cooling action by heat absorption is performed in the evaporator 14.

Here, in the auxiliary heat exchanger 16, heat exchange is performed between the refrigerant of a relatively high temperature directed from the radiator 12 toward the pressure reducer 13, and the refrigerant of a relatively low temperature directed from the evaporator 14 toward the compressor 11. Therefore, since the $CO_2$ refrigerant from the radiator 12 is further cooled, and the pressure of the $CO_2$ refrigerant is reduced, the enthalpy at the inlet of the evaporator 14 decreases, and the enthalpy difference between the inlet and the outlet of the evaporator 14 increases to enhance the heat absorbing ability (cooling ability).

In such refrigeration-cycle equipment having a relatively small volume of the high-pressure-side circuit, if the oil separator 15 is not installed between the compressor 11 and the radiator 12 as in conventional equipment, when oil is discharged from the compressor 11 together with the $CO_2$ refrigerant, particularly in the radiator 12 constituted by the refrigerant path of a plurality of through-holes of a small bore diameter, the oil discharged together with the $CO_2$ refrigerant makes the volume of the high-pressure-side circuit of a small volume further smaller.

At the same time, since the $CO_2$ refrigerant retained in the low-pressure-side circuit moves to the high-pressure-side circuit, sharp pressure rise occurs, and particularly, this occurs easily in the startup or the like of the refrigeration-cycle equipment. If sharp pressure rise occurs in the high-pressure-side circuit, there have been problems that the high-pressure protecting mechanism works to stop the compressor for protecting the radiator, evaporator and compressor of the refrigeration-cycle equipment from the high temperature, and thereby the startup becomes difficult.

However, in Embodiment 1 of the present invention, an oil separator 15 is installed between the compressor 11 and the radiator 12 as FIG. 1 shows.

In such a case, the oil discharged together with the $CO_2$ refrigerant from the compressor 11 is separated in the oil separator 15, and sequentially fed back from the oil outlet pipe of the oil separator 15, through the subsidiary pressure reducer 17, to the compressor 11 present in the low-pressure-side circuit using the auxiliary path 18 connected to the compressor 11 with a pipe, to prevent the sharp shrinkage of the volume of the high-pressure-side circuit due to the discharge of the oil.

Therefore, sharp pressure rise in the high-pressure-side circuit can be lowered, and refrigeration-cycle equipment wherein there is no sharp pressure rise and the high-pressure protecting mechanism does not work in the startup of the refrigeration-cycle equipment can be realized.

Through studies for various constitutions of the oil separator 15, it was found that in order to prevent the sharp shrinkage of the volume of the high-pressure-side circuit due to the discharge of the oil, and to lower the sharp pressure rise in the high-pressure-side circuit, the state wherein the ratio of the weight of the $CO_2$ refrigerant to the weight of the oil circulating the high-pressure-side circuit when the refrigeration-cycle equipment is in operation is substantially 2% or below is preferable.

Furthermore, in order to lower the sharp pressure rise in the high-pressure-side circuit, it was found that the use of the oil insoluble in the $CO_2$ refrigerant in the compressor 11 is preferable. Also, it is preferable to fill the oil in the volume of less than substantially 50% the internal volume of the low-pressure shell excluding the volume of the compressing mechanism, which has a high pressure.

The reason for this is that since the quantity of the refrigerant dissolved in the oil can be decreased by using an insoluble oil, or making the quantity of the oil less than substantially 50% the internal volume of the low-pressure shell, disturbance such as the sudden change in the balance of the quantity of the refrigerant retained in the high-pressure-side circuit and the low-pressure-side circuit caused by the bubbling of the refrigerant that has been dissolved in the oil can be reduced.

It was also found as a result of studying the hydraulic-power-corresponding diameters of the through-holes formed in the flat tube constituting the radiator 12, that the hydraulic-power-corresponding diameters of 0.2 mm to 6.0 mm could lower the sharp pressure rise in the high-pressure-side circuit in the refrigeration-cycle equipment having the internal volume of the high-pressure-side circuit less than 70% the total internal volume.

Here, the reason why the hydraulic-power-corresponding diameter was limited to 0.2 mm or more was that if it was less than 0.2 mm, the hole was too small and easily choked by a small quantity of the oil, and there was possibility that sharp pressure rise in the high-pressure-side circuit could not be lowered.

On the other hand, the reason why it was limited to 6.0 mm or less is that if it is larger than 6.0 mm, other problems may occur, wherein the thickness of the flat tube will increase when the strength design is performed to resist the high pressure of the $CO_2$ refrigerant, consequently making the radiator larger, or the heat-transmission performance will lower.

Furthermore, in order to prevent sharp pressure rise on startup in refrigeration-cycle equipment having the internal volume of the high-pressure-side circuit being less than substantially 70% the total internal volume, it was found that it is preferable that the quantity of the $CO_2$ refrigerant filled in the circuit is 0.25 kg per liter or less on the basis of the total internal volume of the circuit.

Even when the quantity of the $CO_2$ refrigerant is 0.25 kg per liter or less on the basis of the total internal volume, since the internal volume of the high-pressure-side circuit is as small as less than substantially 70% the total internal volume, the high-pressure-side pressure in operation can be caused to agree to the optimal high-pressure-side pressure, and the operation in a relatively high freezing capacity and at a high efficiency can be performed.

As FIG. 1 shows, when the location of the oil separator 15 is between the compressor 11 and the radiator 12, there are side benefits to prevent the oil from interfering with the heat transmission of the $CO_2$ refrigerant, and increasing pressure loss in the radiator 12, thereby improving the heat exchange efficiency.

The location of the oil separator 15 may be anywhere as long as it is in a part of the high-pressure-side circuit, and may be between the radiator 12 and the pressure reducer 13.

In this case, since the temperature of the oil fed back to the compressor 11 can be lowered by the radiator 12 and the auxiliary heat exchanger 16, there are side benefits of preventing the elevation of the temperature in the low-pressure shell of the compressor 11, and of improving the efficiency of the compressor.

(Embodiment 2)

Figure 2:
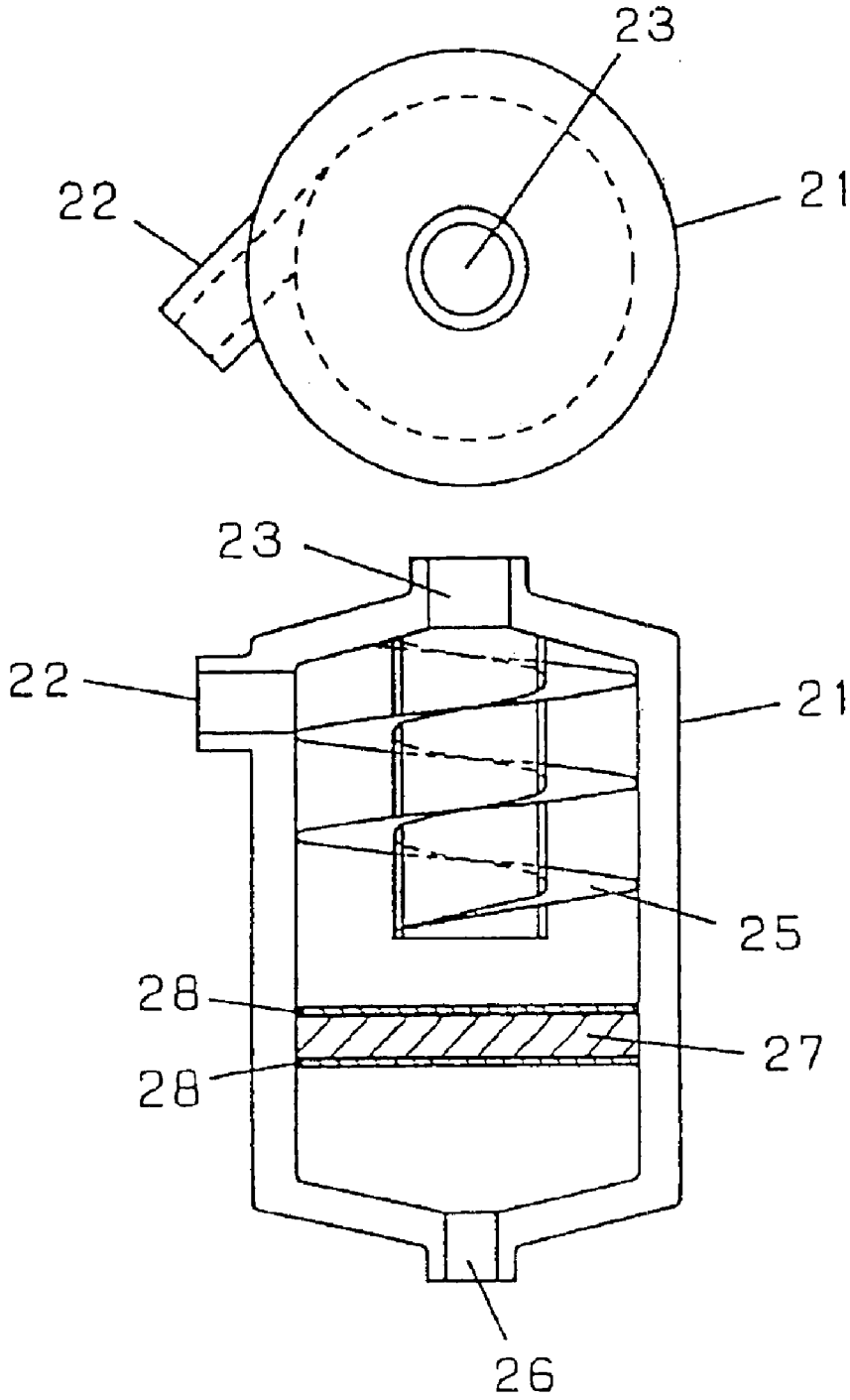
FIG. 2 is a schematic constitution diagram of the oil separator according to Embodiment 2 of the present invention.

FIG. 2 is a schematic constitution diagram of the oil separator 15 according to the above-described Embodiment 1.

In the drawing, in the oil separator 15, an inlet pipe 22 formed so that the $CO_2$ refrigerant and the oil flow in the tangential direction to the inside peripheral surface is installed on the upper portion of the cylindrical vessel 21, and an oil outlet pipe 26 is installed on the lower end of the vessel 21. A refrigerant outlet pipe 23 is installed so as to pass through the center of the upper end of the vessel 21, and to extend downwardly. Furthermore, a revolving plate 25 is installed on the outer periphery of the refrigerant outlet pipe 23 in the vessel 21.

The operation of the oil separator having such a structure will be described together with the relationship with FIG. 1. After the $CO_2$ refrigerant and the oil discharged from the compressor 11 flow in through the inlet pipe 22, they collide with the revolving plate 25, given revolving motion, and the oil droplets having a density larger than the density of the $CO_2$ refrigerant are separated by centrifugal force. Since the $CO_2$ refrigerant wherefrom the oil has been separated is a gas refrigerant, the $CO_2$ refrigerant passes through the refrigerant outlet pipe 23 extending in the vessel, and flows out to the radiator 12 connected from the refrigerant outlet pipe 23 with a pipe.

On the other hand, separated oil droplets fall by gravity, and are stored in the lower portion of the vessel 21, and fed back to the compressor 11 from the oil outlet pipe 26 through the auxiliary path 18 connected to the compressor 11 with a pipe.

The subsidiary pressure reducer 17 installed in the auxiliary circuit 18 may be controlled so as to open automatically when the quantity of the oil stored in the oil separator 15 reaches a certain level, or may be controlled so as to open periodically.

By installing the oil separator of such a structure, and feeding back the oil sequentially to the compressor 11 present in the low-pressure-side circuit, the sharp shrinkage of the volume of the high-pressure-side circuit due to the discharge of the oil can be prevented, and the sharp pressure rise of the high-pressure-side circuit can be lowered.

Furthermore, in the oil separator of such a structure, although the vessel 21 requires a certain degree of internal volume to separate the $CO_2$ refrigerant and the oil, the side benefit to reduce the sharp pressure rise of the high-pressure-side circuit is also obtained since the vessel 21 retains the refrigerant temporarily, and plays the role of a buffer to reduce sharp change in the quantity of the refrigerant by connecting the oil separator to the high-pressure-side circuit.

Therefore, by connecting the oil separator of such a structure to the high-pressure-side circuit, refrigeration-cycle equipment without sharp pressure rise on the high-pressure side and without the operation of the high-pressure protecting mechanism in the startup of the refrigeration-cycle equipment can be realized.

A demister 27, which is a fine net formed by knitting fibrous metal wires, for catching and separating oil droplets and preventing the oil stored in the lower portion of the vessel from flowing out from the refrigerant outlet pipe 23, and a metal plate 28 having a plurality of holes for holding the demister 27, may be installed on the lower portion of the vessel 21.

The refrigerant storage chamber of the present invention corresponds to the internal space of the vessel 21 (however, when the oil is stored in the bottom, the space excluding the oil storage portion). The oil separating means of the present invention corresponds to the revolving plate 25 and the like.

(Embodiment 3)

Embodiment 3 of the present invention uses a compressor of a low-pressure shell type as the compressor 11 in FIG. 1, which is a linear compressor of (1) an oil-less type using no oil, or (2) an oil-poor type using a small quantity of oil.

A linear compressor is a compressor for compressing and discharging a refrigerant by reciprocally moving a piston slidably supported by the cylinder in the shell using a linear motor. When a linear compressor of an oil-less type or an oil-poor type is used, since no or an extremely small quantity of oil is discharged together with a $CO_2$ refrigerant from the compressor 11, the oil separator 15, the subsidiary pressure reducer 17 or the auxiliary path 18 can be omitted from the refrigeration-cycle equipment of FIG. 1.

Although the linear compressor requires the sliding motion in the state wherein the cylinder and the piston are in contact with each other, since it does not require bearings, which are required in a conventional compressor using a rotary motor, other members do not always require sliding motion in the contact state.

Therefore, the surface treatment to the piston or the cylinder improves durability, has the effect of lowering the coefficient of friction, and enables operation without using oil.

Also by adopting a gas bearing wherein the refrigerant gas circulating in the refrigeration-cycle equipment is flowed between the piston and the cylinder under a high pressure, the refrigeration-cycle equipment can be operated without using oil.

Also by the formation of a porous surface layer on the piston or the cylinder, the oil is retained on the porous surface layer; therefore, the compressor can be operated using an extremely small quantity of oil.

It should be appreciated that in the refrigeration-cycle equipment of such a constitution, the internal volume of the high-pressure-side circuit becomes less than substantially 70% the total internal volume. However, when a linear compressor of an oil-less type or an oil-poor type is used, since no or an extremely small quantity of oil is discharged from the compressor 11, the sharp shrinkage of the volume of the high-pressure-side circuit due to the discharge of the oil can be prevented, and the sharp pressure rise in the high-pressure-side circuit can be lowered.

Therefore, refrigeration-cycle equipment without sharp pressure rise and without the operation of the high-pressure protecting mechanism in the startup of the refrigeration-cycle equipment can be realized.

It was also found that in order to prevent the sharp shrinkage of the volume of the high-pressure-side circuit due to the discharge of the oil, and to lower sharp pressure rise in the high-pressure-side circuit, the oil-poor state wherein the ratio of the weight of the oil to the weight of the $CO_2$ refrigerant circulating in the high-pressure-side circuit during the operation of the refrigeration-cycle equipment is substantially 2% or less is desired.

Furthermore, in the refrigeration-cycle equipment wherein the hydraulic-power-corresponding diameter of a plurality of through-holes formed in the flat tube constituting the radiator 12 is substantially 0.2 mm to 6.0 mm, and the internal volume of the high-pressure-side circuit is less than 70% the total internal volume, it is desired to make the quantity of the $CO_2$ refrigerant filled in the circuit substantially 0.25 kg or less per liter of the total internal volume of the circuit, as in Embodiment 1.

Even when the quantity of the $CO_2$ refrigerant is substantially 0.25 kg per liter of the total internal volume, since the internal volume of the high-pressure-side circuit is as small as less than 70% the total internal volume, the high-pressure-side pressure in operation can be caused to agree to the optimal high-pressure-side pressure, and the operation in a relatively high freezing capacity and at a high efficiency can be performed.

(Embodiment 4)

Figure 3:
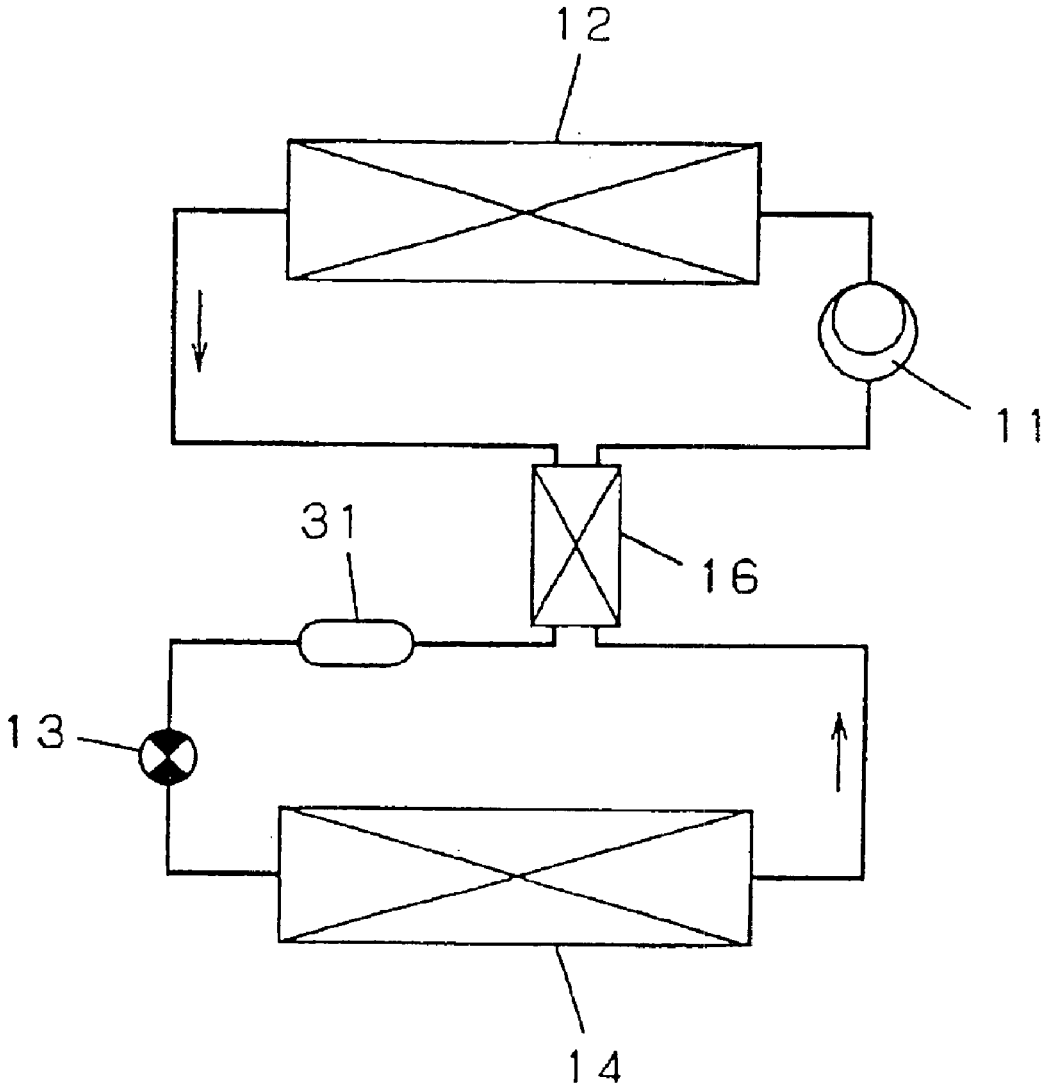
FIG. 3 is a schematic constitution diagram of refrigeration-cycle equipment according to Embodiment 4 of the present invention.
Figure 4:
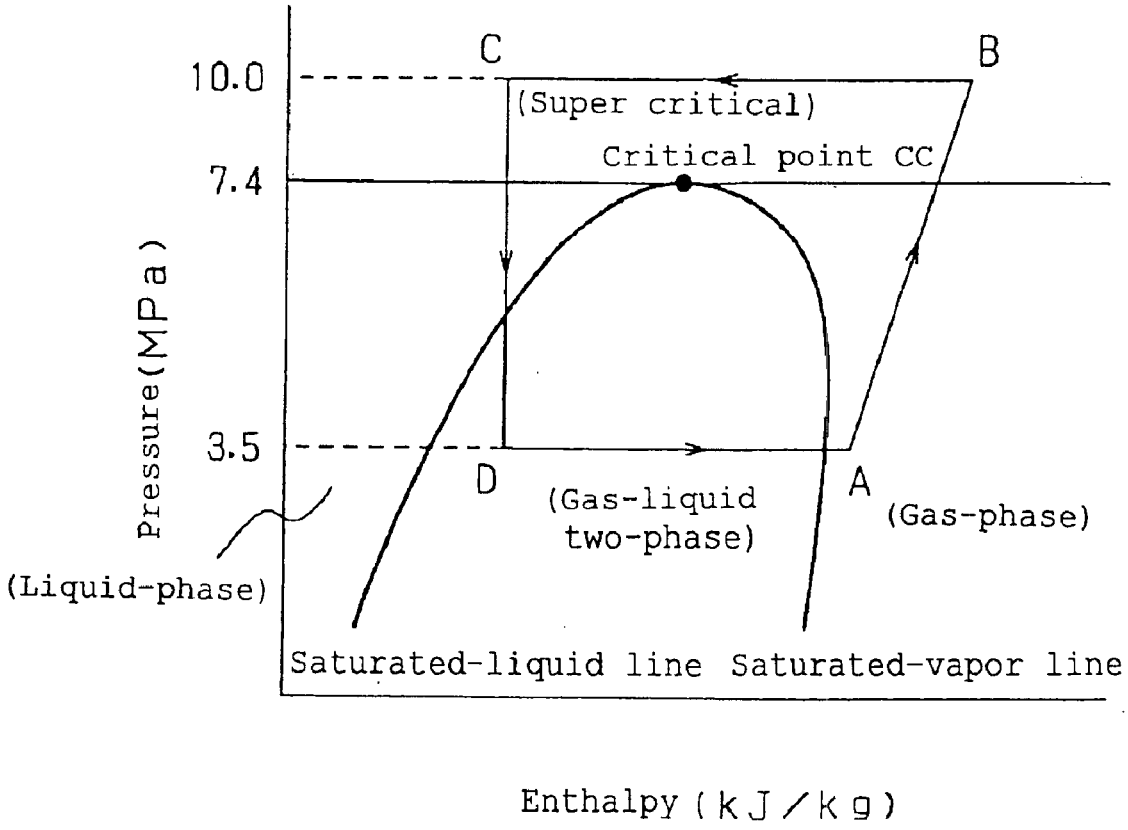
FIG. 4 is a schematic Mollier diagram of the refrigeration cycle using carbon dioxide.
Figure 5:
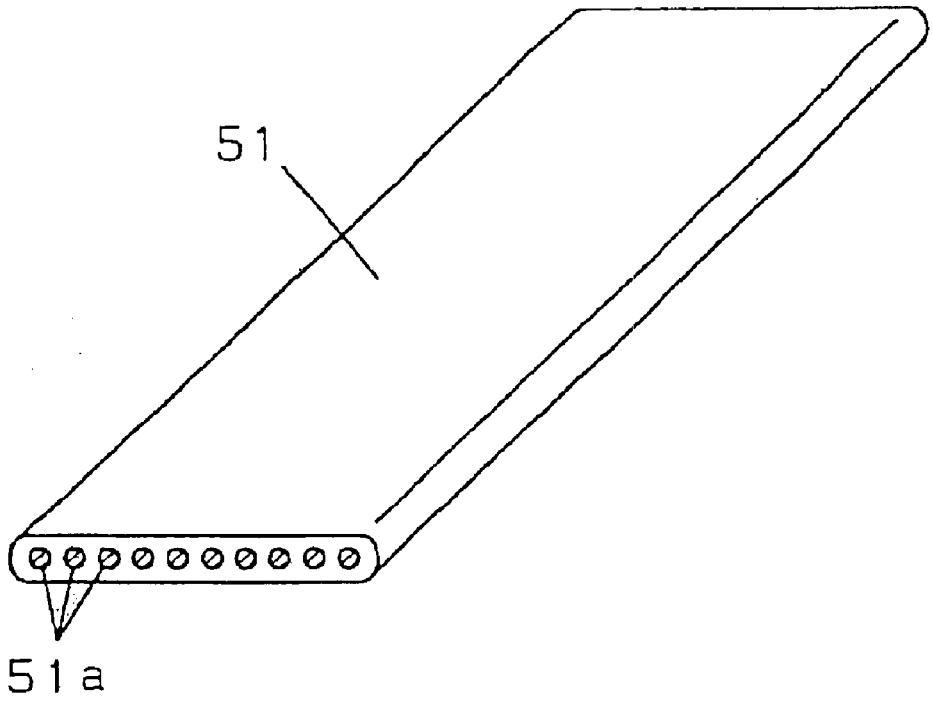
FIG. 5 is a schematic constitution diagram of a flat tube composing a heat exchanger.

The refrigeration-cycle equipment according to Embodiment 4 of the present invention is schematically shown in FIG. 3. In FIG. 3, the same constituent elements as in FIG. 1 will be denoted by the same reference numerals as in FIG. 1, and the description thereof will be omitted.

In Embodiment 4, a refrigerant storage vessel 31 is installed between the auxiliary heat exchanger 16 and the pressure reducer 13. The refrigerant storage vessel 31 is a substantially cylindrical hollow vessel having openings for piping connection at the both ends.

The internal volume of the high-pressure-side was less than substantially 70% the total internal volume even when the refrigerant storage vessel 31 of the refrigeration-cycle equipment of such a constitution is included.

In such a refrigerant storage vessel 31, since the $CO_2$ refrigerant and the oil cannot be separated, and the oil cannot be fed back to the compressor, the sharp shrinkage of the volume of the high-pressure-side circuit due to the discharge of the oil cannot be prevented; however, since the refrigerant storage vessel 31 retains the refrigerant temporarily, and plays the role of the buffer to reduce rapid change in the quantity of the refrigerant, the benefit of reducing the sharp pressure rise of the high-pressure-side circuit is maintained.

The refrigerant storage vessel 31 is connected to the outlet side of the radiation-side refrigerant path formed between the outlet side of the radiator and the inlet side of the pressure reducer in the auxiliary heat exchanger 16. The $CO_2$ refrigerant in this location is the refrigerant cooled by the radiator 12 and further cooled by the auxiliary heat exchanger 16, and is in the state of the highest density in the high-pressure-side circuit.

In other words, since the density of the $CO_2$ refrigerant is large even if the size of the refrigerant storage vessel 31 is reduced and the internal volume is decreased, a sufficient side benefit to reduce the sharp pressure rise of the high-pressure-side circuit can be obtained.

Therefore, by connecting the refrigerant storage vessel 31 to the high-pressure-side circuit, particularly by connecting the refrigerant storage vessel 31 to the location where the density of the $CO_2$ refrigerant is high, refrigeration-cycle equipment without sharp pressure rise and without the operation of the high-pressure protecting mechanism in the startup of the refrigeration-cycle equipment can be realized.

The vessel member of the present invention corresponds to the refrigerant storage vessel 31. Also, the refrigerant cooling means of the present invention corresponds to the auxiliary heat exchanger 16.

Figure 7:
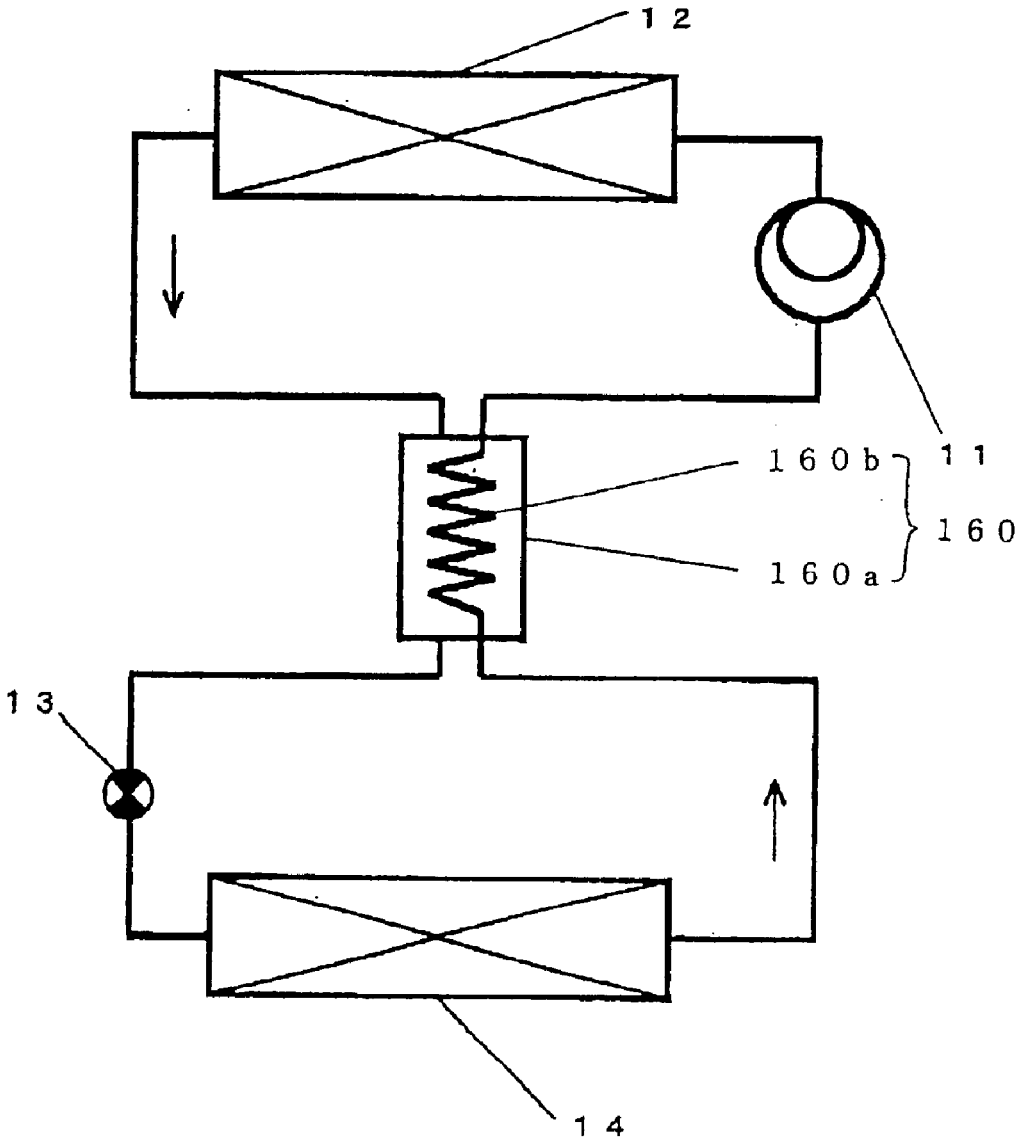
FIG. 7 is a schematic constitution diagram showing a modified example of refrigeration-cycle equipment according to Embodiment 4 of the present invention.

Although the vessel member of the present invention is described for the case to embody as the refrigerant storage vessel 31 in this embodiment, it is not limited thereto, but can have the structure wherein an auxiliary heat exchanger 160 has also the function of the refrigerant storage vessel 31 as FIG. 7 shows.

In this case, since the high-pressure-side circuit 160*a* constituting the auxiliary heat exchanger 160 is formed to have a larger internal volume than the high-pressure-side circuit of the auxiliary heat exchanger 16 in FIGS. 1 and 3, the high-pressure-side circuit 160*a* is able to have the function to store the refrigerant, as well as the heat exchange function with the low-pressure-side circuit 160*b*. Thereby, the same effect as described above can be obtained.

(Embodiment 5)

Figure 6:
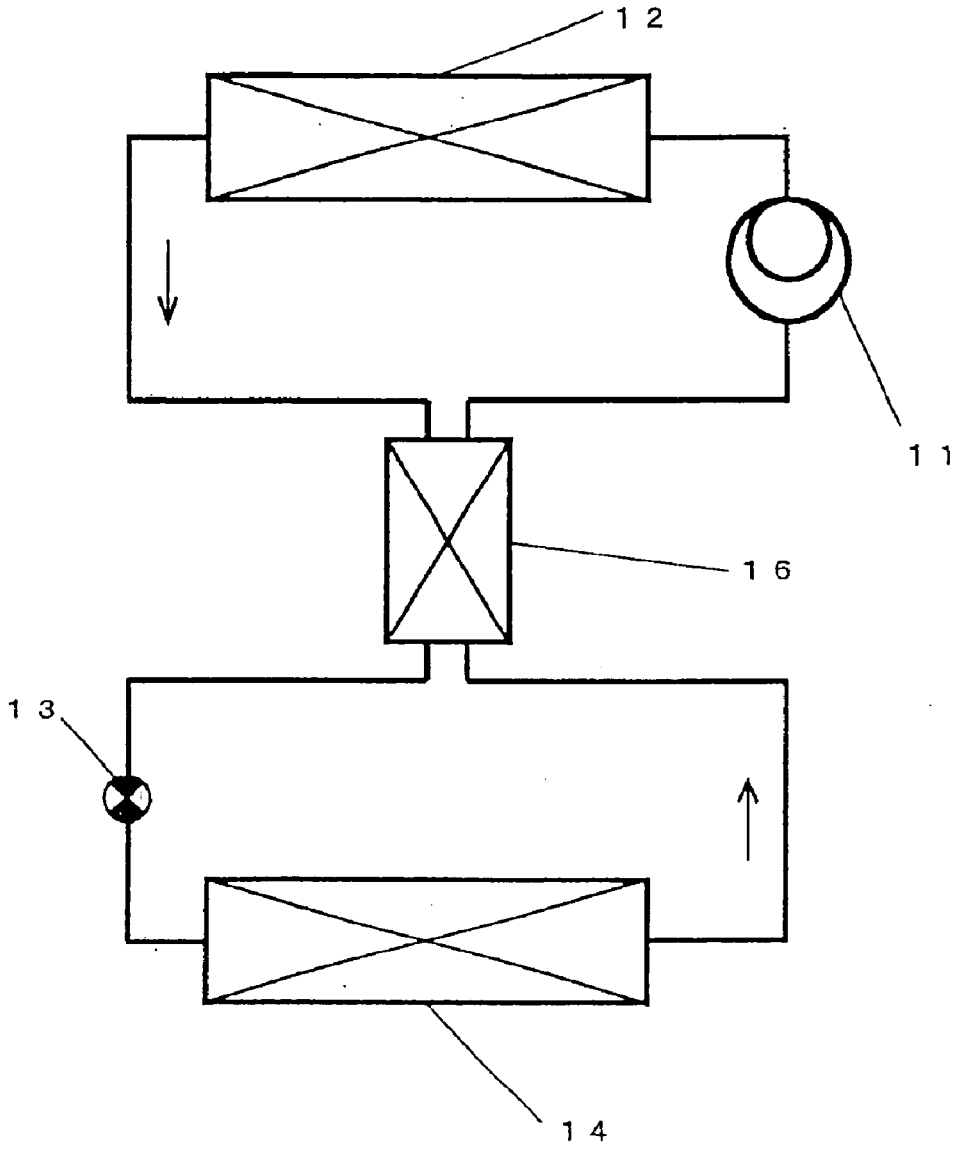
FIG. 6 is a schematic constitution diagram of refrigeration-cycle equipment according to Embodiment 5 of the present invention.

The constitution of refrigeration-cycle equipment according to Embodiment 5 of the present invention is schematically shown in FIG. 6. In FIG. 6, the same constituent elements as in FIG. 1 will be denoted by the same reference numerals as in FIG. 1, and the description thereof will be omitted.

In Embodiment 5, no refrigerant storage vessel is installed in the high-pressure-side circuit, and the internal volume of the high-pressure-side circuit is less than substantially 70% the total internal volume.

In such refrigeration-cycle equipment, since oil cannot be fed back to the compressor 11 as in Embodiment 1, and in addition, no refrigerant storage vessel that plays the role of the buffer to retain the refrigerant temporarily to reduce rapid change in the quantity of the refrigerant is installed, it was found after the measures to avoid the sharp pressure rise of the high-pressure-side circuit was studied, that the sharp pressure rise of the high-pressure-side circuit could be reduced when the quantity of the $CO_2$ refrigerant filled in the circuit was substantially 0.25 kg or less per liter of the total internal volume of the circuit.

Specifically, when the quantity of the refrigerant retained in the low-pressure-side circuit is shifted to the high-pressure-side circuit, the pressure of the high-pressure-side circuit starts to elevate. On the contrary, since the quantity of the $CO_2$ refrigerant filled in the low-pressure-side circuit is as small as 0.25 kg or less per liter of the total internal volume of the circuit, the pressure of the low-pressure-side circuit lowers due to decrease in the quantity of the refrigerant retained in the low-pressure-side circuit; and since the quantity of the $CO_2$ refrigerant shifted from the low-pressure side to the high-pressure side decreases due to density lowering of the $CO_2$ refrigerant sucked in the compressor 11, the sharp pressure rise of the high-pressure-side circuit can be reduced, and refrigeration-cycle equipment without the operation of the high-pressure protecting mechanism due to sharp high-pressure rise can be realized.

Even when the quantity of the $CO_2$ refrigerant is 0.25 kg per liter or less of the total internal volume, since the internal volume of the high-pressure-side circuit is as small as less than substantially 70% the total internal volume, the high-pressure-side pressure in operation can be caused to agree to the optimal high-pressure-side pressure, and the operation in a relatively high freezing capacity and at a high efficiency can be performed.

Furthermore, when the ratio of the weight of the oil to the weight of the $CO_2$ refrigerant circulating in the high-pressure-side circuit of the refrigeration-cycle equipment during operation is made substantially 2% or less by incorporating the oil separating mechanism in the compressor 11; an insoluble oil is used as the $CO_2$ refrigerant; the oil is filled in the volume less than substantially 50% the internal volume of the low-pressure shell excluding the volume of the compressing mechanism of a high pressure; the radiator 12 is constituted using a flat tube containing a plurality of through-holes of the hydraulic-power-corresponding diameter of substantially 0.2 mm to 6.0 mm; or a linear compressor of an oil-less type or an oil-poor type is used as the compressor 11, sharp pressure rise of the high-pressure-side circuit is further reduced as in the above described Embodiments 1 and 3.

In the above-described Embodiment 1, although the case wherein the auxiliary heat exchanger 16 is installed only between the radiator 12 and the evaporator 14 is described, the present invention is not limited thereto, but may be constituted to lower the temperature of the oil separator 15, for example, by providing a heat exchange function by passing a part of the low-pressure-side circuit in the oil separator.

In the above-described embodiments, although the case wherein a compressor of a low-pressure shell type is used as the compressor is described, the present invention is not limited thereto, but basically any type of compressor can be used as long as the internal volume of the high-pressure-side circuit in the refrigerant circuit is less than substantially 70% the total internal volume of the refrigerant circuit.

Also in the above-described embodiments, although the case wherein the hydraulic-power-corresponding diameter of a plurality of through-holes constituting a radiator is any one within a range between 0.2 mm and 6.0 mm, the present invention is not limited thereto, but a radiator may be constituted, for example, from through-holes having a plurality of diameters within the range between substantially 0.2 mm and 6.0 mm.

As obviously known from the above description, according to the present invention, by installing an oil separator, using a linear compressor of an oil-less type or an oil-poor type, and desirably making the ratio of the weight of the oil to the weight of the $CO_2$ refrigerant circulating in the high-pressure-side circuit of the refrigeration-cycle equipment during operation substantially 2% or less, the sharp shrinkage of the volume of the high-pressure-side circuit due to the discharge of the oil can be prevented, and the sharp pressure rise of the high-pressure-side circuit can be reduced.

Furthermore, by installing an oil separator and a refrigerant vessel such as a refrigerant storage vessel in a part of the high-pressure-side circuit, the refrigerant can be temporarily retained in the refrigerant vessel, and the sharp pressure rise of the high-pressure-side circuit can be reduced.

Furthermore, by making the quantity of the $CO_2$ refrigerant filled in the circuit substantially 0.25 kg or less per liter of the total internal volume of the circuit, sharp pressure rise on startup can be reduced.

Furthermore, by filling an insoluble oil in the $CO_2$ refrigerant, and by filling oil in less than substantially 50% the internal volume of the low-pressure shell excluding the volume of the compressing mechanism of a high pressure, the quantity of the refrigerant dissolved in the oil can be reduced, and the disturbance such as rapid change in the balance of the quantity of the refrigerant retained in the high-pressure-side circuit and the low-pressure-side circuit can be reduced.

According to the present invention, as described above, refrigeration-cycle equipment wherein the pressure is not sharply risen on the high-pressure side, or the high-pressure protecting mechanism does not work in the startup of the refrigeration-cycle equipment using a $CO_2$ refrigerant can be realized.

As obviously known from the above description, the present invention has the advantage that sharp pressure rise in the refrigerant circuit can be reduced compared to conventional equipment.

What is claimed is:

1. Refrigeration-cycle equipment whose refrigerant circuit comprises at least a compressor, a pressure reducer, a radiator and an evaporator, and encloses a refrigerant comprising mainly carbon dioxide ($CO_2$), wherein the internal volume of the high-pressure-side circuit of said refrigerant circuit is less than substantially 70% of the total internal volume of said refrigerant circuit, and a predetermined vessel member is provided in the way of said high-pressure-side circuit, wherein said vessel member is a vessel having a piping cross-sectional area larger than the piping cross-sectional area of said refrigerant circuit, and includes internally a refrigerant reservoir chamber and/or oil separating means.

2. The refrigeration-cycle equipment according to claim 1, wherein said vessel member is a cylindrical vessel; and said vessel member comprises (1) an inlet pipe installed in the vicinity of the upper end of said cylindrical vessel, and in the tangential direction to the inside peripheral surface of said cylindrical vessel; (2) a refrigerant outlet pipe installed through the center portion of the upper end of said cylindrical vessel, and inside said cylindrical vessel downwardly; (3) an oil outlet pipe installed on the lower end of said vessel; and (4) a revolving plate imparting revolution to the refrigerant and the oil installed in said vessel.

3. The refrigeration-cycle equipment according to claims 1 or 2 further comprising refrigerant cooling means for cooling said refrigerant by using a part of a high-pressure-side circuit and a part of a low-pressure-side circuit, wherein said vessel member is installed between said refrigerant cooling means and said pressure reducer.

4. The refrigeration-cycle equipment according to claim 3, wherein said refrigerant cooling means is an auxiliary heat exchanger for exchanging heat between a radiation-side refrigerant flow path formed between the outlet side of said radiator and the inlet side of said pressure reducer, and an evaporation-side refrigerant flow path formed between the outlet side of said evaporator and the suction side of said compressor.

5. Refrigeration-cycle equipment whose refrigerant circuit comprises at least a compressor, a pressure reducer, a radiator and an evaporator, and encloses a refrigerant comprising mainly carbon dioxide ($CO_2$), wherein the internal volume of the high-pressure-side circuit of said refrigerant circuit is less than 70% of the total internal volume of said refrigerant circuit, and a predetermined vessel member is provided in said high-pressure-side circuit, disposed between said radiator and said compressor.

6. Refrigeration-cycle equipment whose refrigerant circuit comprises at least a compressor, a pressure reducer, a radiator and an evaporator, and encloses a refrigerant comprising mainly carbon dioxide ($CO_2$), wherein the internal volume of the high-pressure-side circuit of said refrigerant circuit is less than substantially 70% of the total internal volume of said refrigerant circuit, a predetermined vessel member is provided in the way of said high-pressure-side circuit, and refrigerant cooling means for cooling said refrigerant by using a part of a high-pressure-side circuit and a part of a low-pressure-side circuit, wherein a part of said high-pressure-side circuit is also used as said vessel member.

7. The refrigeration-cycle equipment according to any of claims 2, or 6, wherein a ratio of weight of an oil to weight of carbon dioxide ($CO_2$) refrigerant circulating said high-pressure-side circuit is substantially 2% or below when said refrigeration-cycle equipment is in operation.

8. The refrigeration-cycle equipment according to any of claims 2, or 6, wherein the carbon dioxide ($CO_2$) refrigerant of a quantity of substantially 0.25 kg or less per liter is filled in said refrigerant circuit.

9. The refrigeration-cycle equipment according to any of claims 2, or 6, wherein an oil is filled in the volume less than substantially 50% an internal volume of a shell excluding volume of a compression mechanism portion out of volume of said compressor.

10. The refrigeration-cycle equipment according to any of claims 2, or 6, wherein said compressor is a linear compressor of an oil-less type or an oil-poor type.

11. The refrigeration-cycle equipment according to any of claims 2, or 6, wherein said radiator has a constitution wherein a plurality of through-holes having a hydraulic-power corresponding diameter of substantially 0.2 mm to 6.0 mm formed in a flat tube are used as the refrigerant paths.

12. The refrigeration-cycle equipment according to any of claims 2, or 6, wherein an oil filled in said compressor is an oil insoluble in carbon dioxide ($CO_2$) refrigerant.

13. Refrigeration-cycle equipment whose refrigerant circuit comprises at least a compressor, a pressure reducer, a radiator and an evaporator, and an internal volume of a high-pressure-side circuit is less than 70% a total internal volume of said refrigerant circuit, wherein carbon dioxide ($CO_2$) refrigerant of a quantity of substantially 0.25 kg or less per liter is filled in said refrigerant circuit.

14. The refrigeration-cycle equipment according to claim 13, wherein a ratio of weight of an oil to weight of the carbon dioxide ($CO_2$) refrigerant circulating said high-pressure-side circuit is substantially 2% or below when said refrigeration-cycle equipment is in operation.

15. The refrigeration-cycle equipment according to claims 13 or 14, wherein an oil is filled in the volume less than substantially 50% an internal volume of a shell excluding volume of a compression mechanism portion out of the volume of said compressor.

16. The refrigeration-cycle equipment according to any of claims 13 or 14, wherein said compressor is a linear compressor of an oil-less type or an oil-poor type.

17. The refrigeration-cycle equipment according to any of claims 13 or 14, wherein said radiator comprises a plurality of through-holes having a hydraulic-power corresponding diameter of substantially 0.2 mm to 6.0 mm formed in a flat tube are used as the refrigerant paths.

18. The refrigeration-cycle equipment according to any of claims 13 or 14, wherein oil in said compressor is an oil insoluble in the carbon dioxide ($CO_2$) refrigerant.

19. Refrigeration-cycle equipment whose refrigerant circuit comprises at least a compressor, a pressure reducer, a radiator and an evaporator, and encloses a refrigerant comprising mainly carbon dioxide ($CO_2$), wherein the internal volume of the high-pressure-side circuit of said refrigerant circuit is less than substantially 70% of the total internal volume of said refrigerant circuit, a predetermined vessel member is provided in the way of said high-pressure-side circuit, and refrigerant cooling means for cooling said refrigerant by using a part of a high-pressure-side circuit and a part of a low-pressure-side circuit, wherein said vessel member is installed between said refrigerant cooling means and said pressure reducer.

20. Refrigeration-cycle equipment whose refrigerant circuit comprises at least a compressor, a pressure reducer, a radiator and an evaporator, and encloses a refrigerant comprising mainly carbon dioxide ($CO_2$), wherein the internal volume of the high-pressure-side circuit of said refrigerant circuit is less than substantially 70% of the total internal volume of said refrigerant circuit, and a predetermined vessel member is provided in the way of said high-pressure-side circuit, wherein a ratio of weight of an oil to weight of carbon dioxide ($CO_2$) refrigerant circulating said high-pressure-side circuit is substantially 2% or below when said refrigeration-cycle equipment is in operation.

21. Refrigeration-cycle equipment whose refrigerant circuit comprises at least a compressor, a pressure reducer, a radiator and an evaporator, and encloses a refrigerant comprising mainly carbon dioxide ($CO_2$), wherein the internal volume of the high-pressure-side circuit of said refrigerant circuit is less than substantially 70% of the total internal volume of said refrigerant circuit, and a predetermined vessel member is provided in the way of said high-pressure-side circuit, wherein the carbon dioxide ($CO_2$) refrigerant of a quantity of substantially 0.25 kg or less per liter is filled in said refrigerant circuit.

22. Refrigeration-cycle equipment whose refrigerant circuit comprises at least a compressor, a pressure reducer, a radiator and an evaporator, and encloses a refrigerant comprising mainly carbon dioxide ($CO_2$), wherein the internal volume of the high-pressure-side circuit of said refrigerant circuit is less than substantially 70% of the total internal volume of said refrigerant circuit, and a predetermined vessel member is provided in the way of said high-pressure-side circuit, wherein an oil is filled in the volume less than substantially 50% an internal volume of a shell excluding volume of a compression mechanism portion out of volume of said compressor.

23. Refrigeration-cycle equipment whose refrigerant circuit comprises at feast a compressor, a pressure reducer, a radiator and an evaporator, and encloses a refrigerant comprising mainly carbon dioxide ($CO_2$), wherein the internal volume of the high-pressure-side circuit of said refrigerant circuit is less than substantially 70% of the total internal volume of said refrigerant circuit, and a predetermined vessel member is provided in the way of said high-pressure-side circuit, wherein said compressor is a linear compressor of an oil-less type or an oil-poor type.

24. Refrigeration-cycle equipment whose refrigerant circuit comprises at least a compressor, a pressure reducer, a radiator and an evaporator, and encloses a refrigerant comprising mainly carbon dioxide (CO2), wherein the internal volume of the high-pressure-side circuit of said refrigerant circuit is less than substantially 70% of the total internal volume of said refrigerant circuit, and a predetermined vessel member is provided the way of in said high-pressure-side circuit, wherein said radiator has a constitution wherein a plurality of through-holes having a hydraulic-power corresponding diameter of substantially 0.2 mm to 6.0 mm formed in a flat tube are used as the refrigerant paths.

25. Refrigeration-cycle equipment whose refrigerant circuit comprises at least a compressor, a pressure reducer, a radiator and an evaporator, and encloses a refrigerant comprising mainly carbon dioxide ($CO_2$), wherein the internal volume of the high-pressure-side circuit of said refrigerant circuit is less than substantially 70% of the total internal volume of said refrigerant circuit, and a predetermined vessel member is provided in the way of said high-pressure-side circuit, wherein an oil filled in said compressor is an oil insoluble in carbon dioxide ($CO_2$) refrigerant.

* * * * *

UNITED STATES PATENT AND TRADEMARK OFFICE

CERTIFICATE OF CORRECTION

PATENT NO. : 6,871,511 B2
DATED : March 29, 2005
INVENTOR(S) : Noriho Okaza et al.

It is certified that error appears in the above-identified patent and that said Letters Patent is hereby corrected as shown below:

Title page,
Item [56], References Cited, OTHER PUBLICATIONS, "Caisonic" should read -- Calsonic --.

Column 14,
Lines 47, 52, 56, 61 and 64, between "claims" and "2," insert -- 1, --.

Column 15,
Line 2, between "claims" and "2," insert -- 1, --.

Column 16,
Line 25, "feast" should read -- least --.

Signed and Sealed this

Thirtieth Day of August, 2005

JON W. DUDAS
*Director of the United States Patent and Trademark Office*